United States Patent [19]

Williams

[11] 4,135,678

[45] Jan. 23, 1979

[54] TOILET PAPER ROLL DISPENSER AND HOLDER

[76] Inventor: James A. Williams, 4120 Morning Pl., Sarasota, Fla. 33581

[21] Appl. No.: 797,028

[22] Filed: May 16, 1977

[51] Int. Cl.[2] ..... B65H 19/04

[52] U.S. Cl. ..... 242/55.3; 242/55.53

[58] Field of Search ..... 242/55.3, 55.53; 312/37–41; 225/41–50; 221/14, 191, 194

[56] References Cited

U.S. PATENT DOCUMENTS

| | | | |
|---|---|---|---|
| 589,050 | 8/1897 | Warnock | 221/194 |
| 2,592,346 | 4/1952 | Scogin | 242/55.3 |
| 3,254,792 | 6/1966 | Danielson et al. | 221/14 |
| 3,279,715 | 10/1966 | Vedvig | 242/55.3 |

*Primary Examiner*—Leonard D. Christian
*Attorney, Agent, or Firm*—Hauke and Patalidis

[57] ABSTRACT

A dispenser for paper rolls such as rolls of toilet paper, in the form of a substantially J-shaped container having a vertically disposed portion of a cross section wide enough to accommodate freely a plurality of superimposed paper rolls. The container has a horizontally extending projecting outlet portion having a bottom wall smoothly merging curvilinearly with the rear wall of the container's vertical portion, such that when a paper roll is removed from the end of the horizontal bottom portion, provided with an outlet aperture for that purpose, the next roll is gently pushed by gravity as a result of the pressure exerted upon it by the remaining rolls in the container vertical portion. The container and dispenser of the invention may be mounted on a wall, such as a bathroom wall, or it may be built into the wall. Preferably, the container is provided with a paper roll holder disposed above the paper roll outlet aperture, and with a trap door disposed at the top of the container vertical portion for filling it with paper rolls.

14 Claims, 4 Drawing Figures

TOILET PAPER ROLL DISPENSER AND HOLDER

BACKGROUND OF THE INVENTION

The present invention relates to a paper roll container and dispenser, and more particularly the invention relates to a gravity fed container and dispenser for a plurality of rolls of tissue paper, such as toilet paper, provided with a built-in paper roll holder.

Storage of tissue paper rolls, and more particularly toilet paper rolls often presents a problem for a household. If stored in a closet outside of a bathroom, a fresh toilet paper roll is not conveniently available to a user presented with the unfortunate occurrence of an empty or almost empty toilet paper roll. Obviously, if the bathroom is provided with storage cabinets or closets, a provision of toilet paper rolls may be kept within easy reach. However, because the rolls are usually stored out of sight within a cabinet or storage space provided with a non-transparent door, there is never a complete assurance, when facing an empty or almost empty roll of toilet paper in the bathroom holder, that even a single roll remains in the storage area for convenient and rapid access in case of necessity.

The present invention remedies those inconveniences by providing a magazine-type container and dispenser for a supply of fresh toilet paper rolls, conveniently located on or in the bathroom wall itself and presenting at all times by simple visual check an assurance that one or more rolls remain available from the supply.

SUMMARY OF THE INVENTION

The present invention has for principal object to provide a convenient magazine-type container and dispenser for tissue paper rolls, more particularly toilet paper rolls, which has a neat and attractive appearance and which, once loaded with an appropriate supply of rolls, feeds the rolls to an outlet by gravity, one by one. The container and dispenser of the present invention may be mounted in a convenient location on the wall of a bathroom or may be built in the wall, and has an inlet access aperture, preferably provided with a door, and an open outlet aperture. A tissue paper roll holder may be permanently secured to the container dispenser of the invention, such that a modular complete appliance is thus provided.

BRIEF DESCRIPTION OF THE DRAWING

The invention will be best understood by those skilled in the art when the following description of the best mode contemplated for practicing the invention is read in conjunction with the accompanying drawing wherein.

DETAILED DESCRIPTION OF THE PREFERRED EMBODIMENTS

Figure 1:
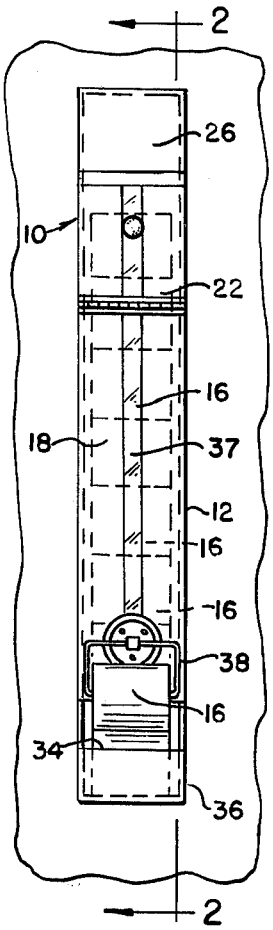
FIG. 1 is a front elevation view of a tissue paper roll container and dispenser according to the present invention.
Figure 2:
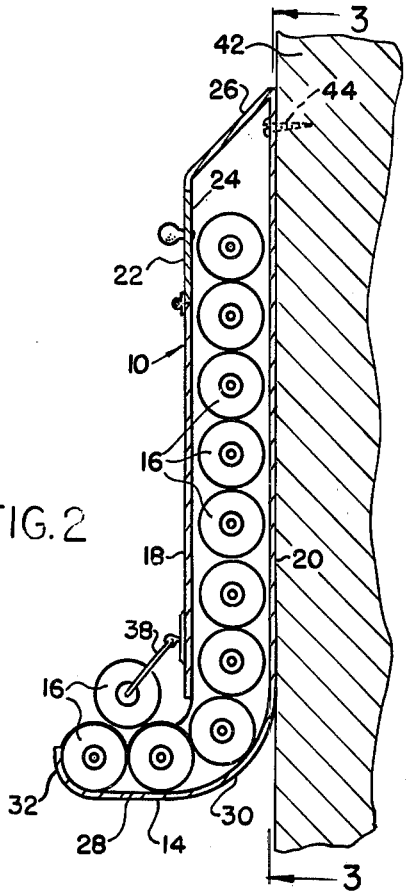
FIG. 2 is a sectional view from line 2—2 of FIG. 1.

Referring now to FIGS. 1–2, a magazine-type container and dispenser for a plurality of tissue paper rolls, such as toilet paper rolls, consists of a generally J-shaped box or housing 10 having a vertically disposed main body portion 12 and a generally horizontal forward projecting outlet portion 14. The width of the main vertical body portion 12 of the box 10 is such as to loosely accept a plurality of tissue paper rolls 16 disposed on top of each other, with the axes of the rolls substantially parallel to the front wall 18 and the rear wall 20 of the box 10. The distance between the front wall 18 and the rear wall 20 is such as to accomodate the rolls 16 freely but with limited lateral clearance, such as to avoid jams and permit the rolls 16 to be freely fed by gravity to the bottom outlet portion 14 of the dispenser. A hinged door 22, disposed at the top of the front wall 18 of the vertical portion 12 of the box 10 permits, through an access aperture 24, to load the box with a supply of superimposed rolls 16. If so desired, the access door 22 may be disposed such as to replace the slanted top wall 26 of the container and dispenser of FIGS. 1–2.

The box 10 forming the container and dispenser may be made of any convenient material such as thin sheet steel and the like, but it is preferably molded of a single piece of thermoplastic or thermosetting plastic material. The outlet lower portion 14 is preferably formed integrally with the main body portion 12 of the container, and has a bottom wall 28 which, on one end, smoothly and gradually merges curvilinearly, as shown at 30, at FIG. 2, with the rear wall 20 of the main vertical body portion 12 of the box 10. The radius of the curvilinear portion 30 of the bottom wall 28 is substantially larger than the radius of the rolls 16, such as to prevent any tendency for the rolls to engagingly conform with a small radius chute surface which could cause a jam. Providing a wide radius for the curvilinear surface 30 insures that, under the pressure exerted by the immediately above-situated adjacent roll, a roll at the elbow formed by the gently curved surface 30 will be pushed forward in the outlet horizontal portion 14 until it abuts the end wall 32 of the horizontal portion. The forward projecting horizontal portion 14 is provided with a top access aperture 34, and its sidewalls 36 have a height less than the diameter of a roll 16, such that the rolls disposed in the trough-like outlet portion 14 of the container and dispenser may be easily manually grasped and removed when needed. The trough-like outlet portion 14 is preferably long enough so that a pair of rolls 16 are disposed one behind the other, with a portion of their periphery projecting through the aperture 34, for the purpose of providing a visual indication that at least one roll is still available from the container and dispenser. In addition, a visual check of the contents of the container and dispenser box 10 may be provided by means of forming the front of the container and dispenser box 10 of a transparent plastic which is subsequently painted leaving a transparent strip 37, longitudinally, i.e., vertically disposed.

A roll holder 38 is conveniently hingedly mounted on the surface of the front wall 18 above the dispensing outlet aperture 34.

Figure 3:
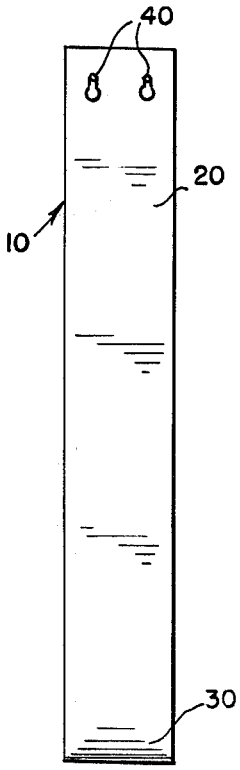
FIG. 3 is a rear elevation view thereof.
Figure 4:
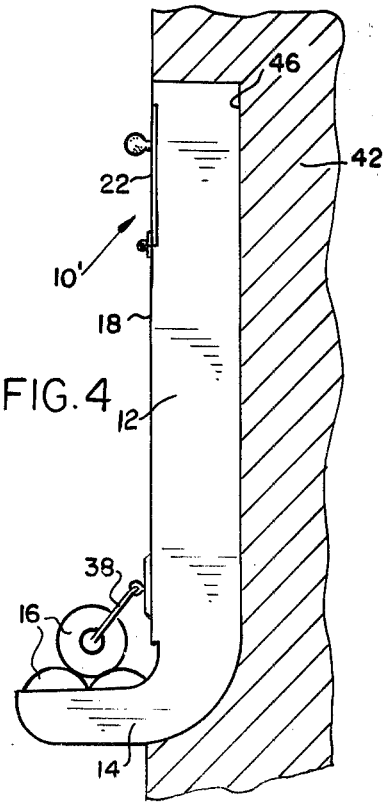
FIG. 4 is a side elevation view of a modification thereof.

As shown at FIG. 3, the rear wall 20 of the container and dispenser box 10 is provided with a pair of mounting holes 40 for attachment to a wall 42, FIG. 2, by means of appropriate fasteners such as screws 44.

The container and dispenser of FIGS. 1–3 is a convenient improvement accessory for an already existing bathroom. In a new installation, however, an appropriate recess 46 may be formed in the wall 42, of a height, depth and width adequate to accomodate the box or housing 10' of a container and dispenser according to the invention, with the front wall 18 thereof substantially flush with the surface of the wall 42, such that the front wall 18 may be painted the same color as the rest of the bathroom wall or covered with the same wallpaper, the outlet projecting portion 14 being the only portion of the container dispenser projecting from the bathroom wall 42.

Having thus described the invention by way of typical structural embodiments thereof, modifications whereof will be apparent to those skilled in the art, what is claimed as new is as follows:

1. A container and dispenser for a plurality of rolls of tissue paper comprising a substantially J-shaped container having a vertically disposed main body portion having a front wall and a rear wall separated by a distance wide enough to accommodate snuggly but without friction a plurality of paper rolls disposed one above the other, an integral forward projecting lower portion having a top aperture and partial sidewalls leaving exposed a portion of the periphery of paper rolls displaced by gravity into said projecting lower portion, said lower portion having a bottom wall with an integral curvilinear rearward section gradually merging into said rear wall, an access opening formed in said body portion proximate the top thereof for filling said container and dispenser with a plurality of said paper rolls, and a paper roll holder mounted on the front surface of the front wall of said body portion proximate said lower projecting portion, wherein said paper roll holder is mounted at a predetermined distance above said aperture in said lower portion such that a fresh paper roll placed in said holder peripherally engages a paper roll disposed in said projecting lower portion.

2. The container and dispenser of claim 1 wherein said access opening is provided with a door.

3. The container and dispenser of claim 1 wherein said curvilinear bottom wall portion is of a radius larger than the radius of said paper rolls.

4. The container and dispenser of claim 1 wherein said container and dispenser main body portion is mounted on a wall surface.

5. The container and dispenser of claim 1 wherein said main body portion is mounted in a recess in a wall, said projecting lower portion projecting from said wall.

6. The container and dispenser of claim 1 wherein said main body portion has a front wall provided with a vertically extending transparent strip for visual check of the contents of said body portion.

7. A container and dispenser for a plurality of rolls of tissue paper comprising a substantially J-shaped container having a vertically disposed main body portion having a front wall and a rear wall separated by a distance wide enough to create a channelway to accommodate snugly but without friction a plurality of paper rolls disposed one above the other, an integral forward projecting lower portion having a top aperture and partial end wall and sidewalls leaving exposed a portion of the periphery of paper rolls displaced by gravity into said projecting lower portion with the first one of said paper rolls abutting against said end wall and supporting the weight of the remaining paper rolls disposed in said channelway, said lower portion having a bottom wall with an integral curvilinear rearward section gradually merging into said rear wall and said end wall, and an access opening formed in said body portion proximate the top thereof for filling said container and dispenser with a plurality of said paper rolls.

8. The container and dispenser of claim 7 wherein said access aperture is provided with a door.

9. The container and dispenser of claim 7 wherein said curvilinear bottom wall portion is of a radius larger than the radius of said paper rolls.

10. A container and dispenser for a plurality of rolls of tissue paper comprising a substantially J-shaped container having a vertically disposed main body portion having a front wall and a rear wall separated by a distance wide enough to accommodate snugly but without friction a plurality of paper rolls disposed one above the other, an integral forward projecting lower portion having a top aperture and partial end wall and sidewalls leaving exposed a portion of the periphery of paper rolls displaced by gravity into said projecting lower portion with the first one of said paper rolls abutting against said end wall, said lower portion having a bottom wall with an integral curvilinear rearward section gradually merging into said rear wall and said end wall, and an access opening formed in said body portion proximate the top thereof for filling said container and dispenser with a plurality of said paper rolls and further comprising a paper roll holder mounted on the front surface of the front wall of said body portion proximate said lower projecting portion and above said aperture.

11. The conainer and dispenser of claim 10 wherein said paper roll holder is mounted at a predetermined distance above said aperture in said lower portion such that a fresh paper roll placed in said holder peripherally engages a paper roll disposed in said projecting lower portion.

12. The container and dispenser of claim 7 wherein said container and dispenser main body portion is mounted on a wall surface.

13. The container and dispenser of claim 7 wherein said main body portion is mounted in a recess in a wall, said projecting lower portion projecting from said wall.

14. The container and dispenser of claim 7 wherein said main body portion has a front wall provided with a vertically extending transparent strip for visual check of the contents of said body portion.

* * * * *